US006259875B1

(12) United States Patent
Miura et al.

(10) Patent No.: US 6,259,875 B1
(45) **Date of Patent: *Jul. 10, 2001**

(54) CHARGING MEMBER AND CHARGING DEVICE

(75) Inventors: Hiroyuki Miura; Hiroyuki Kataoka; Hiroshi Takayama, all of Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/373,208

(22) Filed: Aug. 12, 1999

(30) Foreign Application Priority Data

Aug. 26, 1998 (JP) ..... 10-240914

(51) Int. Cl.[7] ..... B03B 15/02
(52) U.S. Cl. ..... 399/176; 361/225; 428/323
(58) Field of Search ..... 399/176; 361/225; 428/323

(56) References Cited

U.S. PATENT DOCUMENTS 5,751,801 * 5/1998 Murata et al. ..... 399/176
6,134,408 * 10/2000 Kataoka et al. ..... 399/176

FOREIGN PATENT DOCUMENTS 7-134467 5/1995 (JP) .
2649163 5/1997 (JP) .
10-148995 6/1998 (JP) .

* cited by examiner

*Primary Examiner*—Mark Chapman
(74) *Attorney, Agent, or Firm*—Oliff & Berridge, PLC

(57) ABSTRACT

A charging member has a conductive core, a conductive elastic layer formed on the surface of the conductive core, and a wearing surface layer to be used also as a resistance controlling layer formed on the surface of the conductive elastic layer, and comprising a surface layer-forming resin and a resistance controlling conductive filler, developing conductivity by electron conduction and having a specific wearing amount of $5.0\times10^{-4}$ ($mm^3/N\cdot km$) or more, the charging member capable of preventing deterioration of the charging performance of a charging member caused by contamination of the surface layer of the charging member, and maintaining stable and satisfactory uniform charging property and image quality for a long period of time, and always keeping the surface clean by positively wearing the surface layer of the charging member.

12 Claims, 2 Drawing Sheets

CHARGING MEMBER AND CHARGING DEVICE

BACKGROUND OF THE INVENTION

1. Field of the Invention

Figure 1:
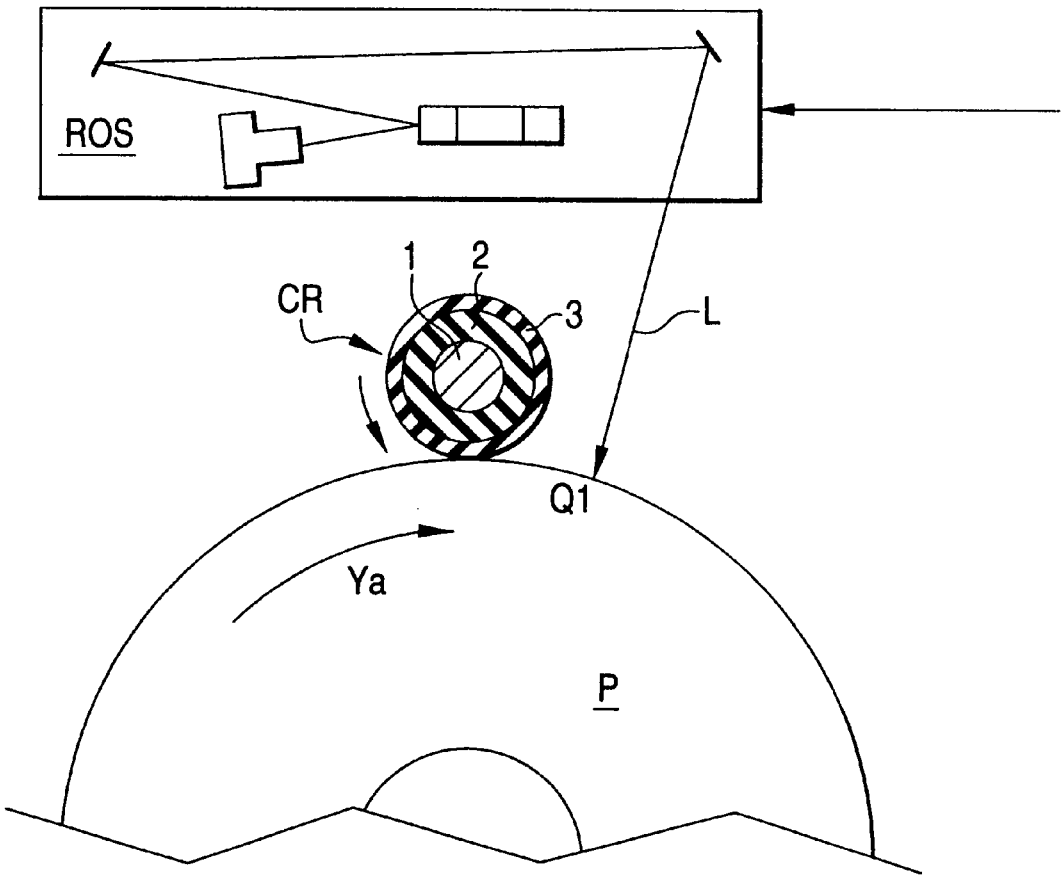

The present invention concerns a charging member for charging a material to be charged such as a light sensitive material for use in electrophotography and electrostatic recording processes in image forming apparatus such as electrophotographic copying machines and printers. More specifically, it relates to a charging member to be pressed on the surface of a material to be charged such as a light sensitive material and a dielectric material for uniformly charging the surface of the material to be charged, and a charging device.

2. Description of the Related Art

In electrophotographic apparatus, uniform charging is conducted to the surface of a material to be charged such as a light sensitive material and a dielectric material. A method of conducting charging by corona generated by applying a high voltage to metal wires has been adopted as a charging treatment means. However, the corona charging method involves a drawback that corona-induced products such as ozone and nitrogen oxide (NOx) formed upon charging denature the surface of the light sensitive material to deteriorate the light sensitive material or cause image blurring, and that the contamination of the wires gives an undesired effect on the image quality, leading to whitening and streaking.

In addition to the non-contact method described above, there is a contact method of conducting charging by bringing a charging member into contact with a material to be charged. The contact type charging method has an advantage that a voltage to be applied to the charging member is generally low and the amount of ozone formed is extremely small. However, it has a drawback that a toner or an external toner additive passing through a cleaning blade deposits or fuses on the charging member to cause image defects due to failed charging caused by contamination.

As a technique for improving such drawbacks, the technique disclosed in Japanese Patent Unexamined Publication 7-134467 has been known for instance.

The publication discloses a charging member in which a lubricant is contained in a surface layer formed on the surface of an elastic layer. The technique has a contamination-preventing effect due to the reduction of dynamic friction coefficient in an initial stage.

However, the technique has a problem that a hard material such as the external toner additive thrusts into the surface of the charging member during continuous use, which triggers adhesion of the toner. The surface layer of the charging member is made of a less wearing material including the technique and is formed to a thickness of about 10 $\mu$m in the related art.

Therefore, the surface layer of the charging member is also contaminated during long time use, resulting in charging failure.

SUMMARY OF THE INVENTION

In view of the above, the object of the present invention is to prevent deterioration of the charging performance of a charging member caused by contamination of the surface layer of the charging member, to maintain stable and satisfactory uniform charging property and image quality for a long period of time.

Another object of the present invention is to positively abrade the surface layer of the charging member contaminated by a toner to always keep the surface clean thereby maintaining stable and satisfactory uniform charging property and image quality for a long period of time.

The present invention achieved for overcoming the foregoing problems is to be explained next, in which each constituent of the present invention is depicted by a reference numeral for the constituent surrounded by parentheses corresponding to the reference numeral in example to be described later for facilitating correspondence with the constitution in the examples. The reason for explaining the present invention corresponding to the reference numerals of the examples is for better understanding of the present invention, and not for limiting the scope of the present invention only to that of the examples.

The foregoing object can be attained in accordance with the present invention by a charging member pressed to the surface of the material to be charged for charging the material to be charged, having the following conditions:

a conductive core;

a conductive elastic layer formed on the surface of the conductive core; and a wearing surface layer to be used also as a resistance controlling layer formed on the surface of the conductive elastic layer for controlling the resistance value between the surface of the conductive core material and the surface of the charging member, and comprising of a surface layer-forming resin and a resistance controlling conductive filler for developing conductivity by electron conduction and having a specific wearing amount of $5.0\times10^{-4}$ ($mm^3/N\cdot km$) or more.

In the present invention, the specific wearing amount (unit slide distance, a wearing amount per unit load) is a value measured by a wearing test method for plastics according to JIS K 7218.

The following materials can be used as the surface layer-forming resin for forming the wearing surface layer to be used also as the resistance controlling layer and the resistance controlling conductive filler for developing conductivity by electron conduction described above.

For the surface layer-forming resin: urethane, nylon, acryl, epoxy, phenol, polyester, polyethylene, polyamide, polyimide and polyvinyl butyral resin may be used. Urethane and nylon resin are preferred.

For the resistance controlling conductive filler: carbon black, graphite, metal oxides (for example, tin oxide, titanium oxide, zinc oxide and nickel oxide), different atom doped metal oxides (antimony-doped tin oxide) and metals may be used. Carbon black having pH of 4.0 or less, and tin oxide are preferred.

For the conductive elastic layer: rubber in which the fine powder (carbon black, metal oxide and metal) is dispersed; and silicone, urethane, styrene butadiene, NBR and epichlorohydrin rubber may be used. Silicone and urethane rubber are preferred.

The charging member of the invention having the constitution described above is pressed onto the surface of the material to be charged to thereby charge the material to be charged.

The conductive elastic layer is formed on the surface of the conductive core, and the wearing surface layer to be used also as the resistance controlling layer is formed on the surface of the conductive elastic layer. The wearing surface layer to be used also as the resistance controlling layer has the surface layer-forming resin and the resistance controlling conductive filler for developing conductivity by electron conduction, and controls the resistance value between the conducive core and the surface of the charging member. Since the wearing surface layer to be used also as the resistance controlling layer has a specific wearing amount of $5.0\times10^{-4}$ ($mm^3$/N·km) or more, it tends to be worn easily. Since the contamination formed on the wearing surface layer to be used as the resistance controlling layer can be removed by the wearing of the surface, stable charging property can be obtained for a long period of time.

The charging device in accordance with the present invention comprises: a charging member having a surface layer to be pressed on the surface to be charged for charging the material to be charged; a cleaner for cleaning the surface of the wearing surface layer to be used also as a resistance controlling layer.

In the charging device of the present invention, the surface layer of the charging member is pressed on the surface of the material to be charged. The charging member charges the material to be charged. The cleaner cleans the surface. Accordingly, since the surface of the charging member is hardly contaminated, stable charging property can be obtained for a long period of time.

The wearing surface layer is used also as a resistance controlling layer having a specific wearing amount of $5.0\times10^{-2}$ ($mm^3$/N·km) or less.

If the specific wearing amount is more than $5.0\times10^{-2}$ ($mm^3$/N·km), the amount of contamination caused by materials peeled off by wearing is increased, and the working life of the charging member is shortened.

The wearing surface layer is used also as the resistance controlling layer in which a solid lubricant is dispersed.

The charging member of the present invention having the constitution described above, a solid lubricant present while being dispersed in the surface layer-forming resin of the wearing surface layer to be used also as the resistance controlling layer peels off from the surface of the wearing surface layer to be used also as the resistance controlling layer and acts as a lubricant. In addition, the solid lubricant has a function of promoting wearing of the wearing surface layer to be used also as the resistance controlling layer by peeling off from the surface of the wearing surface layer to be used also as the resistance controlling layer. Accordingly, the specific wearing amount of the wearing surface layer to be used also as the resistance controlling layer can be controlled.

The solid lubricant may be polytetrafluoroethylene, graphite or molybdenum disulfide.

The resistance controlling conductive filler maybe carbon black having a pH of 4.0 or less. Since the carbon black has a good dispersibility to the surface layer-forming resin, it can reduce the scattering of the resistance of the wearing surface layer to be used also as the resistance controlling layer.

When the scattering of the resistance of the wearing surface layer to be used also as the resistance controlling layer is reduced, local insulation breakage of the wearing surface layer to be used also as the resistance controlling layer due to concentration of electric current upon application of a high voltage is scarcely caused. When the local insulation breakage of the wearing surface layer to be used also as the resistance controlling layer does not occur, lowering of the resistance value of the wearing surface layer to be used also as the resistance controlling layer is reduced upon application of the high voltage and the control for the charging potential is facilitated. In addition, a material to be charged easily can be charged uniformly.

In addition, since the resistance values of the electron conductive filler is fluctuated due to circumstantial change (circumstantial temperature and humidity) only in a small range, the control for the charging potential is easy even if a circumstantial change should occur, and a material to be charged can be easily charged uniformly.

The resistance controlling conductive filler may be a fine powder of conductive tin oxide.

The surface layer-forming resin may be a polyurethane. Since the surface layer-forming resin is a polyurethane, and since the solid lubricant present being dispersed in the polyurethane peels off from the surface of the polyurethane, the surface of the polyurethane is worn. Accordingly, the surface of the wearing surface layer (polyurethane) to be used also as the resistance controlling layer can be worn by an appropriate wearing amount.

The polyurethane may have elongation at break of 300% or more and 100% modulus of 100 kgf/$cm^2$ or less. In this case, a uniform contact region (nip) can be formed between the charging member and a light sensitive material thereby capable of providing uniform charging.

BRIEF DESCRIPTION OF THE ACCOMPANYING DRAWINGS

Figure 2:
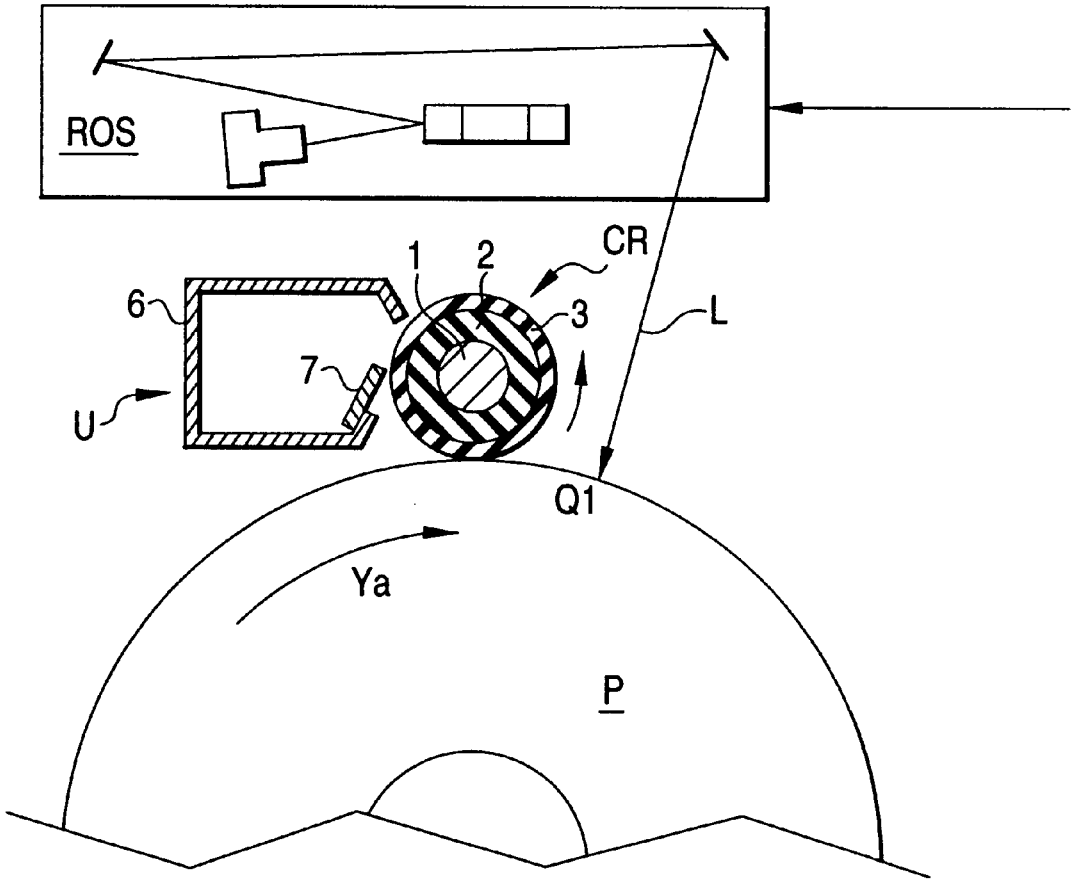

FIG. 1 is a cross sectional view for a charging roll (charging member) in Example 1 of the present invention; and FIG. 2 is an explanatory view for entire the image-forming apparatus in which the Example 1 of a charging device of the present invention is assembled.

EXAMPLES

The present invention will be explained specifically referring to examples below.

FIG. 2 is an explanatory view for Example 1 of the present invention.

In FIG. 2, a charging device U comprises a charging roll CR, a housing 6 for supporting the charging roll CR and a cleaning blade 7. The surface of the charging roll CR is cleaned by the cleaning blade 7, and the materials removed from the surface of the charging roll CR are contained in the housing 6.

Since the surface of the charging roll CR of the charging device U having the constitution described above is cleaned by the cleaning blade 7, contamination is prevented, and stable charging property can be maintained for a long period of time.

Example 1

FIG. 1 is a cross sectional view of a charging roll (charging member) in Example 1 of the present invention.

In FIG. 1, the surface of an image support P rotating in the direction of an arrow Ya is charged uniformly by a charging roll CR, and then latent images are written at a latent image writing position Q1 by a laser beam L emitting from an ROS (latent image writing device).

The charging roll CR is a charging member pressed on the surface of the image support P as a material to be charged to charge the material to be charged (image carrier) P. The charging roll CR comprises a conductive core 1, a conductive elastic layer 2 formed on the surface of the conductive core 1 and a wearing surface layer 3 to be used also as a resistance controlling layer formed on the surface of the conductive elastic layer 2.

The wearing surface layer 3 to be used also as a resistance controlling layer has a surface layer-forming resin and a resistance controlling conductive filler for developing conductivity by electron conduction, and controls the resistance value between the surface of the conductive core 1 and the surface of the charging member (the surface of the wearing surface layer 3 to be used also as the resistance controlling layer). The wearing surface layer 3 to be used also as the resistance controlling layer has a specific wearing amount of $5.0\times10^{-4}$ ($mm^3$/N·km) or more.

The charging roll CR of Example 1 shown in FIG. 1 is manufactured as described below.

A conductive liquid silicone rubber (SCL-1506AB, manufactured by Toray Dow Corning Co. Ltd.) was injection molded to a core metal of ϕ8 mm to obtain a molding product having a thickness of 4 mm. The molding product had a hardness according to Asker C method of 40°, and a volume resistivity of $1\times10^5$ Ω/cm at an electric field of 10 V/cm. Then, 30 parts by weight of a PTFE powder (TLP, manufactured by Mitsui Fluorochemical Co. Ltd.) and 40 parts by weight of an acidic carbon black (Monarch 1000, manufactured by Cabot Co. Ltd. U.S.A.) and 100 parts by weight of MEK were added to 100 parts by weight of a solution of a toluene and MEK of a polyurethane resin having elongation at break of 450% and 100% modulus of 100 kgf/$cm^2$ (Nippolan 3113, manufactured by Nippon Polyurethane Co. Ltd.) and, they were mixed in a ball mill to form a liquid dispersion, which was coated on the silicone rubber molding product by a roll coater and dried to form a coating film of 100 μm.

The resistivity of the coating film alone was from $6\times10^9$ to $3\times10^7$ Ω/cm at an electric field of $1\times10^1$ to $5\times10^4$ V/cm.

When the charging roll was assembled to a color copying machine A-color 635 manufactured by Fuji Xerox Co. Ltd. and a printing resistance test was conducted, the nip forming property with the light sensitive material was satisfactory, clear full color images could be obtained even after copying 200,000 sheets, and defects of image quality due to unevenness of charging or leakage and fluctuation of image density caused by circumstantial change were not observed. The specific wearing amount on the surface of the charging member was $5.0\times10^{-4}$ ($mm^3$/N·km).

Example 2

The charging roll of Example 2 has a conductive core 1, a conductive elastic layer 2 and a wearing surface layer 3 to be used also as a resistance controlling layer in the same manner as the charging roll CR shown in FIG. 1, and is manufactured as described below.

20 parts by weight of graphite (CSPE, manufactured by Nippon Graphite Co. Ltd.), 50 parts by weight of tin oxide (S-1, manufactured by Mitsubishi Material Co. Ltd.) and 100 parts by weight of MEK were added to 100 parts by weight of a solution of toluene and MEK of a polyurethane resin having elongation at break of 320% and 100% modulus of 21 kgf/$cm^2$ (Nippolan 3303, manufactured by Nippon Polyurethane Co., Ltd.), they were mixed by a ball mill to form a liquid dispersion, which was coated by a roll coater on a silicone rubber molding product as defined in Example 1 and dried to obtain a coating film of 130 μm.

The resistivity of the coating film alone was $2\times10^8$ to $5\times10^5$ Ω/cm at an electric field of $1\times10^1$ to $5\times10^4$ V/cm.

When the charging roll was assembled in a color copying machine A-color 635 manufactured by Fuji Xerox Co. Ltd. and a printing resistance test was conducted, the nip forming property with the light sensitive material was satisfactory, and clear full color images could be obtained even after copying 200,000 sheets, and defects of image quality due to unevenness of charging or leakage and fluctuation of image density caused by circumstantial change were not observed. The specific wearing amount on the surface of the charging member was $1.0\times10^{-2}$ ($mm^3$/N·km).

Example 3

The charging roll of Example 3 has a conductive core 1, a conductive elastic layer 2 and a wearing surface layer 3 to be used also as a resistance controlling layer in the same manner as the charging roll CR shown in FIG. 1, and is manufactured as described below.

A conductive liquid silicone rubber (SCL-AB, manufactured by Toray Dow Corning Co. Ltd.) was injection molded to a core metal of ϕ8 mm to obtain a molding product having a thickness of 4 mm. The molding product had a hardness according to Asker C method of 25°, and a volume resistivity of $1\times10^7$ Ω/cm at an electric field of 10 V/cm. Then, 200 parts by weight of a PTFE liquid dispersion (Crytox DF, manufactured by Du Pont Co. Ltd.) having 15% solid content and 30 parts by weight of an antimony-doped tin oxide (T-1, manufactured by Mitsubishi Material Co. Ltd.) and 100 parts by weight of MEK were added to 100 parts by weight of a polyurethane resin solution (Nippolan 3113, manufactured by Nippon Polyurethane Co. Ltd.), and they were mixed by a paint shaker to form a liquid dispersion, which was coated on a silicone rubber molding product by a roll coater, and dried to obtain a coating film of 100 μm.

The resistivity of the coating film alone was $1\times10^9$ to $2\times10^6$ Ω/cm at an electric field of $1\times10^1$ to $5\times10^4$ V/cm.

When the charging roll and a charging member cleaner were assembled in a color copying machine A-color 635 manufactured by Fuji Xerox Co. Ltd. and a printing resistance test was conducted, the nip forming property with the light sensitive material was satisfactory, and clear full color images could be obtained even after copying 200,000 sheets, and defects of image quality due to unevenness of charging or leakage and fluctuation of image density caused by circumstantial change were not observed. The specific wearing amount on the surface of the charging member was $5.0\times10^{-2}$ ($mm^3$/N·km)

Comparative Example 1

The charging roll of Comparative Example 1 comprises a conductive core, a conductive elastic layer and a surface layer in the same manner as the charging roll CR shown in FIG. 1, and is manufactured as described below.

A conductive liquid silicone rubber (SCL-1506AB, manufactured by Toray Dow Corning Co., Ltd.) was injection molded to a core metal of ϕ8 mm to obtain a molding product having a thickness of 4 mm. The hardness of the molding product according to Asker C method was 40° and the volume resistivity at an electric field of 10 V/cm was $1\times10^5$ Ω/cm. Then, a conductive PFA of 30 μm (tetrafluoroethylene-perfluoroalkyl vinyl ether copolymer) tube was covered for the silicone rubber molding product.

The resistivity of the PFA tube alone was $5\times10^9$ to $3\times10^4$ Ω/cm at an electric field of $1\times1^1$ to $5\times10^4$ V/cm.

When the charging roll was assembled in a color copying machine A-color 635 manufactured by Fuji Xerox Co. Ltd. and a printing resistance test was conducted, image defects of black stripes appeared after printing about 500 sheets. The charging member was contaminated by the toner and the like, corresponding to the image defects. The specific wearing amount on the surface of the charging member was as small as $1\times10^{-4}$ ($mm^3$/N·km).

Comparative Example 2

A charging roll of Comparative Example 2 comprises a conductive core, a conductive elastic layer and a surface layer in the same manner as the charging roll CR shown in FIG. 1, and is manufactured as described below.

A conductive liquid silicone rubber (manufactured by Toray Dow Corning Co., Ltd.) was injection molded to a core metal of ϕ8 mm to obtain a molding product having a thickness of 4 mm. Molding product has a hardness according to Asker C method of 60°, and a volume resistivity of $1\times10^5$ Ω/cm at an electric field of 10 V/cm. Then, 20 parts by weight of a polypropylene wax (P550, manufactured by Sanyo Kasei Co. Ltd.), 40 parts by weight of acidic carbon black (Monarch 1000, manufactured by Cabot Co. Ltd. U.S.A.) and 100 parts by weight of MEK were added to 100 parts by weight of a polyurethane resin solution (Nippolan 3113, manufactured by Nippon Polyurethane Co. Ltd.) and they were mixed by a ball mill to form a liquid dispersion, which was coated on the silicone rubber molding product by a roll coater, and dried to obtain a coating film of 100 μm.

The resistivity of the coating film alone was $6\times10^8$ to $3\times10^6$ Ω/cm at an electric field of $1\times10^1$ to $5\times10_4$ V/cm.

When the charging roll was assembled to a color copying machine A-color 635 manufactured by Fuji Xerox Co. Ltd. and a printing resistance test was conducted, image defects of black stripes appeared at an initial stage of the test. The charging member was contaminated by the toner and the like corresponding to the image defects. The specific wearing amount on the surface of the charging member was $6.3\times10^{-2}$ ($mm^3$/N·km) and defects of image quality due to leakage was observed.

Results of each of Examples 1 to 3 and Comparative Examples 1 and 2 of the charging member are shown in Table 1.

TABLE 1

| Abrasion amount | Contamination property | Charging property | Leakage |
|---|---|---|---|
| Comp. Example 1 ($1.0 \times 10^{-4}$ $mm^3$/(N · Km)) | Δ | Δ | ○ |
| Example 1 ($5.0 \times 10^{-4}$ $mm^3$/(N · Km)) | ○ | ○ | ○ |
| Example 2 ($1.0 \times 10^{-2}$ $mm^3$/(N · Km)) | ○ | ○ | ○ |
| Example 3 ($5.0 \times 10^{-2}$ $mm^3$/(N · Km)) | ○ | ○ | ○ |
| Comp. Example. 2 ($6.3 \times 10^{-2}$ $mm^3$/(N · Km)) | Δ | Δ | x |

Referring to Table 1, charging rolls CR less contaminated on the surface, having excellent chargeability and with no leakage can be obtained by using a wearing surface layer 3 to be used also as the resistance controlling layer for the surface layer of the charging roll CR.

Namely, since the surface of the charging roll CR of Examples 1 to 3 to be in contact with a material to be charged comprises a wearing surface layer 3 to be used also as the resistance controlling layer has a greater specific wearing amount compared with the existent roll, the surface is less contaminated since the contamination, if occurs, is removed by abrasion. Therefore, a stable charging property can be provided for a long period of time.

The examples of the present invention have been explained specifically above, but the present invention is not limited to the examples, and can be modified variously within a range of the gist of the present invention. For example, the present invention can be applied also to a frictional contact type charging members in addition to the charging rolls.

What is claimed is:

1. A charging member comprising:

a conductive core, a conductive elastic layer formed on the surface of the conductive core, and a surface layer formed on the surface of the conductive elastic layer, and comprising a resin and a resistance controlling conductive filler, and having a specific wearing amount of $5.0\times10^{-4}$ ($mm^3$/N·km) or more.

2. A charging member as defined in claim 1, wherein the specific wearing amount of the surface layer is within a range of from $5.0\times10^{-4}$ ($mm^3$/N·km) to $5.0\times10^{-2}$ ($mm^3$/N·km).

3. A charging member as defined in claim 1, wherein the specific wearing amount of the surface layer is within a range of from $5.0\times10^{-4}$ ($mm^3$/N·km) to $1.0\times10^{-2}$ ($mm^3$/N·km).

4. A charging member as defined in claim 1, wherein the resistance controlling conductive filler is a carbon black having a pH of 4.0 or less.

5. A charging member as defined in claim 1, wherein the resistance controlling conductive filler is a fine powder of conductive tin oxide.

6. A charging member as defined in claim 1, wherein the resin of the surface layer is a polyurethane resin.

7. A charging member as defined in claim 6, wherein the resin of the surface layer is a polyurethane resin having elongation at break of 300% or more and 100% modulus of 100 kgf/$cm^2$ or less.

8. A charging member as defined in claim 1, wherein the surface layer further contains a solid lubricant.

9. A charging member as defined in claim 8, wherein the lubricant is polytetrafluoroethylene.

10. A charging member as defined in claim 8, wherein the lubricant is graphite.

11. A charging member as defined in claim 8, wherein the lubricant is molybdenum disulfide.

12. An image forming apparatus having a charging member according to claim 1.

* * * * *